US005094377A

United States Patent [19]

Stahlecker

[11] Patent Number: 5,094,377

[45] Date of Patent: Mar. 10, 1992

[54] ARRANGEMENT FOR THE TEMPORARY STORAGE OF A YARN

[75] Inventor: Fritz Stahlecker, Josef-Neidhart-Strasse 18, 7347 Bad Ueberkingen, Fed. Rep. of Germany

[73] Assignees: Fritz Stahlecker; Hans Stahlecker, both of Fed. Rep. of Germany

[21] Appl. No.: 653,059

[22] Filed: Feb. 11, 1991

Related U.S. Application Data

[63] Continuation of Ser. No. 365,812, Jun. 14, 1989, abandoned.

[30] Foreign Application Priority Data

Jun. 23, 1988 [DE] Fed. Rep. of Germany ..... 3821120

[51] Int. Cl.[5] ..... D01H 15/00

[52] U.S. Cl. ..... 226/118; 226/95; 57/22; 57/261; 242/35.6 R

[58] Field of Search ..... 55/400; 251/208, 304; 226/118, 119, 7, 95, 115, 108, 117; 57/261, 263, 22; 242/35.6 R, 45

[56] References Cited

U.S. PATENT DOCUMENTS

| | | | |
|---|---|---|---|
| 3,314,621 | 4/1967 | Bous | 242/35.6 R |
| 3,848,820 | 11/1974 | Stutz et al. | 242/35.6 R |
| 3,902,644 | 9/1975 | Bous | 226/95 X |
| 3,907,187 | 9/1975 | Collausig | 226/42 |
| 3,938,306 | 2/1976 | Bous | 57/263 |
| 4,005,505 | 2/1977 | Roberson | 226/7 X |
| 4,174,799 | 11/1979 | d'Agnolo | 226/118 X |
| 4,360,040 | 11/1982 | Cove et al. | 251/208 X |
| 4,946,134 | 8/1990 | Orlandi | 251/208 |

*Primary Examiner*—Daniel P. Stodola
*Assistant Examiner*—P. Bowen
*Attorney, Agent, or Firm*—Evenson, Wands, Edwards, Lenahan & McKeown

[57] ABSTRACT

In an arrangement for the temporary storage of a yarn between a splicing device and a continuously yarn-delivering delivery device, a ring-shaped depositing chamber is provided, which chamber can be rotated around a shaft which is directed transversely to the yarn-conveying direction, the bottom of this depositing chamber being air-permeable and connected to a suction device.

14 Claims, 4 Drawing Sheets

ARRANGEMENT FOR THE TEMPORARY STORAGE OF A YARN

This is a continuation of application Ser. No. 07/365,812, filed June 14, 1989, now abandoned.

BACKGROUND AND SUMMARY OF THE INVENTION

The invention relates to an arrangement for the temporary storage of a yarn between a splicing arrangement and a delivery device for continuously delivering yarn. The temporary storage device has an air-permeable depositing surface which rotates around a shaft and to which a suction device is assigned.

In a known arrangement of this type (GB-A 21 36 461), a perforated roller is provided which is equipped on the inside with a suction device which generates a suction air flow passing through the perforated roller over a certain circumferential area. The delivered yarn, as a result of its twist, is to place itself in loops on the circumference of the roller.

An object of the invention is to develop an arrangement of the initially mentioned type such that, while the dimensions are as small as possible, its operational reliability is ensured even at high delivery speeds.

This object is achieved by providing a ring-shaped depositing chamber, the bottom of which is air-permeable and is connected to a suction device.

In the case of the arrangements constructed according to the invention, it is ensured that the depositing of the delivered yarn takes place in a certain area, which is delimited by the lateral walls of the depositing chamber. As a result, a controlled rewithdrawal of the stored yarn quantity becomes possible also at an increased speed, without the possibility of the occurrence of large speed differences and resulting increases of tension.

In a further development of preferred embodiments of the invention, it is provided that the depositing chamber has a V-shaped cross-section. The yarn can therefore slide toward the bottom at the lateral walls of this depositing chamber.

In a further development of preferred embodiments of the invention, it is provided that the depositing chamber is provided in a front face of a disk-shaped body. As a result, it is possible to provide the withdrawal direction with a component against the moving direction of the depositing chamber so that, also during the withdrawing, controlled conditions will occur and several yarn loops will not be withdrawn simultaneously. In this case, the yarn is withdrawn over the edge of the depositing chamber so that defined conditions exist.

Other objects, advantages and novel features of the present invention will become apparent from the following detailed description of the invention when considered in conjunction with the accompanying drawings.

DETAILED DESCRIPTION OF THE DRAWINGS

Figure 1:
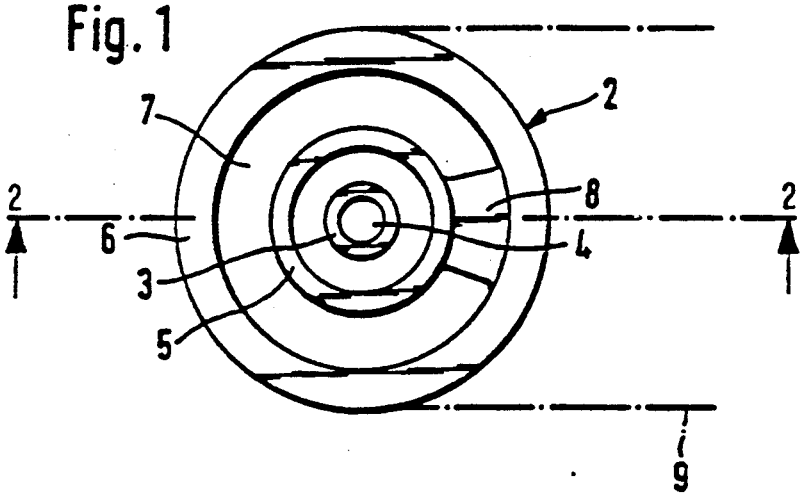
FIG. 1 is a schematic view of a temporary yarn storage arrangement constructed according to a preferred embodiment of the invention, as viewed in the direction of the axis of rotation.
Figure 2:
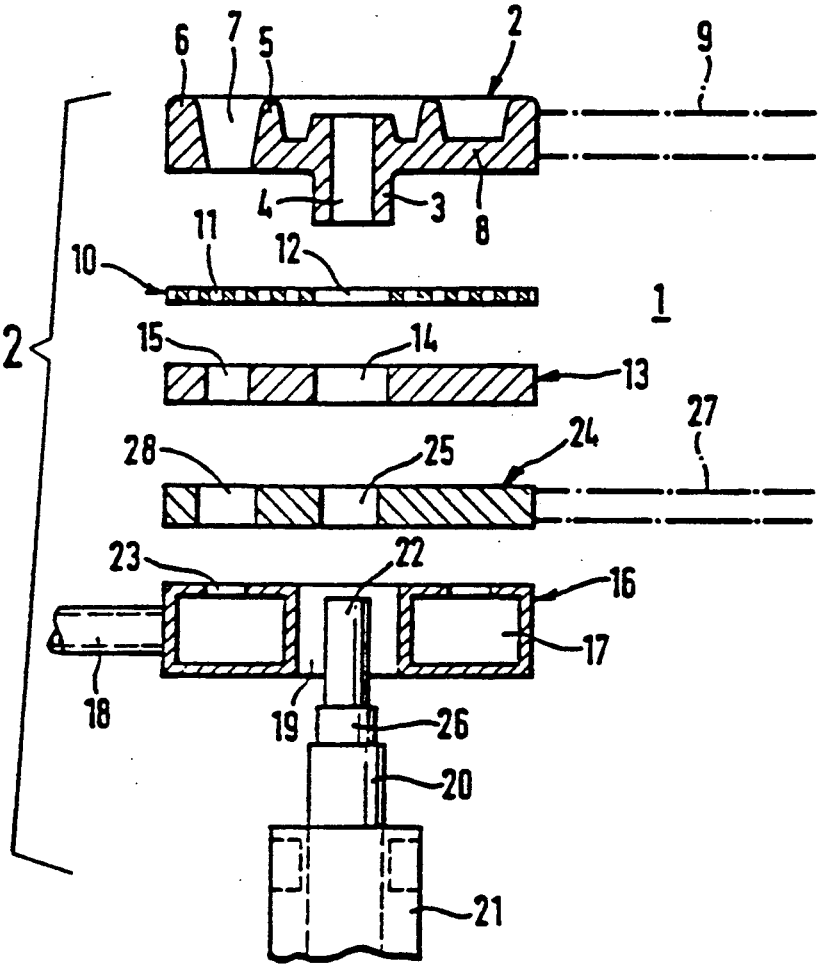
FIG. 2 is an exploded sectional view of the arrangement of FIG. 1 taken along Line II—II of FIG. 1.
Figure 3:
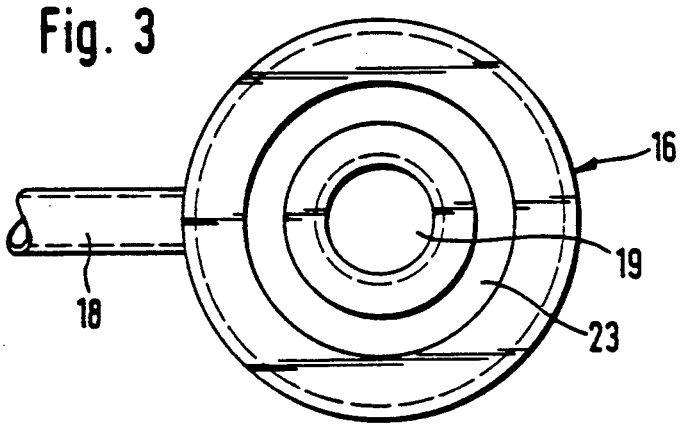
FIG. 3 is a view of a suction chamber, which is part of the arrangement of FIG. 1 and 2.

The shown arrangement 1 contains a disk-shaped basic body 2, which is provided with a hub 3. The hub 3 contains a centric bore 4, by means of which it is pressed onto a journal 22 of a rotatably disposed shaft 20. The disk-shaped basic body 2 has a recess, which is open in the direction of a front face, has a V-shaped cross-section and serves as a depositing chamber 7. The depositing chamber 7 is delimited by two surrounding ring-shaped enlargements 5, 6. The recess is interrupted by a short web 8, which connects the ring-shaped enlargements 5, 6 with one another. The disk-shaped body 2 can be driven by means of a belt, which is shown by a dash-dotted line, such as a toothed belt 9.

The bottom of the depositing chamber 7 is formed by a screen disk 10, which is arranged on the hub 3 of the basic body 2 by means of a centric bore 12 and which has a perforation 11. Below the screen disk 10, a holding disk 13 is arranged, which is also provided with a centric bore 14, by means of which it is fitted onto the hub 3. The holding disk 13 is pressed onto the hub 3. In addition, it may be fastened to the basic body 2 by means of screws, so that the screen disk 10 is clamped in between it and the basic body 2. The holding disk 13 is provided with a surrounding slot 15, which is interrupted only in the area of the web 8, the dimensions of this slot 15 corresponding to the end of the ring-shaped recess 7 which faces the screen disk 10. Between a bearing housing 21 of the shaft 20 and the rear side of the ring-shaped depositing chamber 7, a ring-shaped suction housing 16 is arranged, which has a centric recess 19 surrounding the shaft 20 at a spacing. The housing 16 forms a ring-shaped suction chamber 17, which is provided with a suction connection. On the side facing the disk-shaped body 2, the housing 16 is provided with a surrounding suction slot 23.

Between the suction chamber 17 and the holding disk 13, another intermediate disk 24 is arranged, which, by means of a centric bore 25 is arranged on a collar 26 of the shaft 20 with a sliding fit. The intermediate disk 24 is provided with an approximately horseshoe-shaped slot 28, the dimensions of which correspond essentially to those of the suction slot 23. This slot is interrupted at one point over a given section 29, so that the suction slot 23 is covered in this area.

Figure 4:
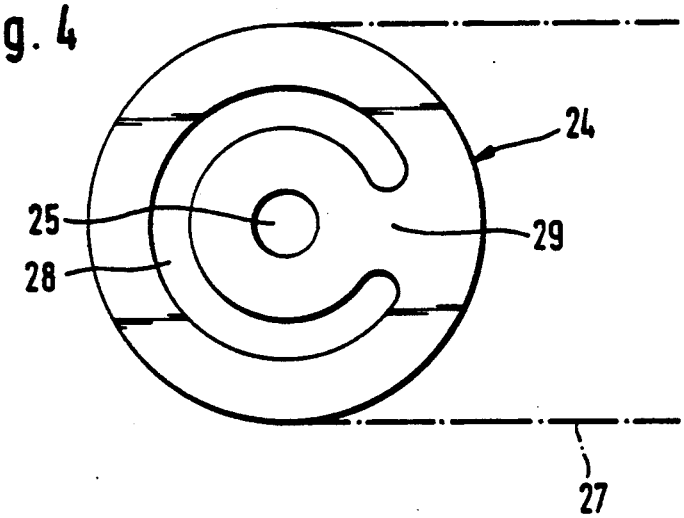
FIG. 4 is a view of a slotted disk arranged between the suction chamber and a depositing chamber of the arrangement of FIG. 1 and 2.

The intermediate disk 24, which is shown by a dash-dotted line, can be adjusted in circumferential direction by means of a belt, such as a toothed belt 27 (also see FIG. 4), so that the position of the interruption 29, by means of which the suction slot 23 is covered, may be changed in circumferential direction.

In a modified embodiment, this type of an intermediate disk 24 is not used. In this case, the housing 16 will then be arranged rotatably and will then be provided with a closed area of the suction slot 23.

Figure 5:
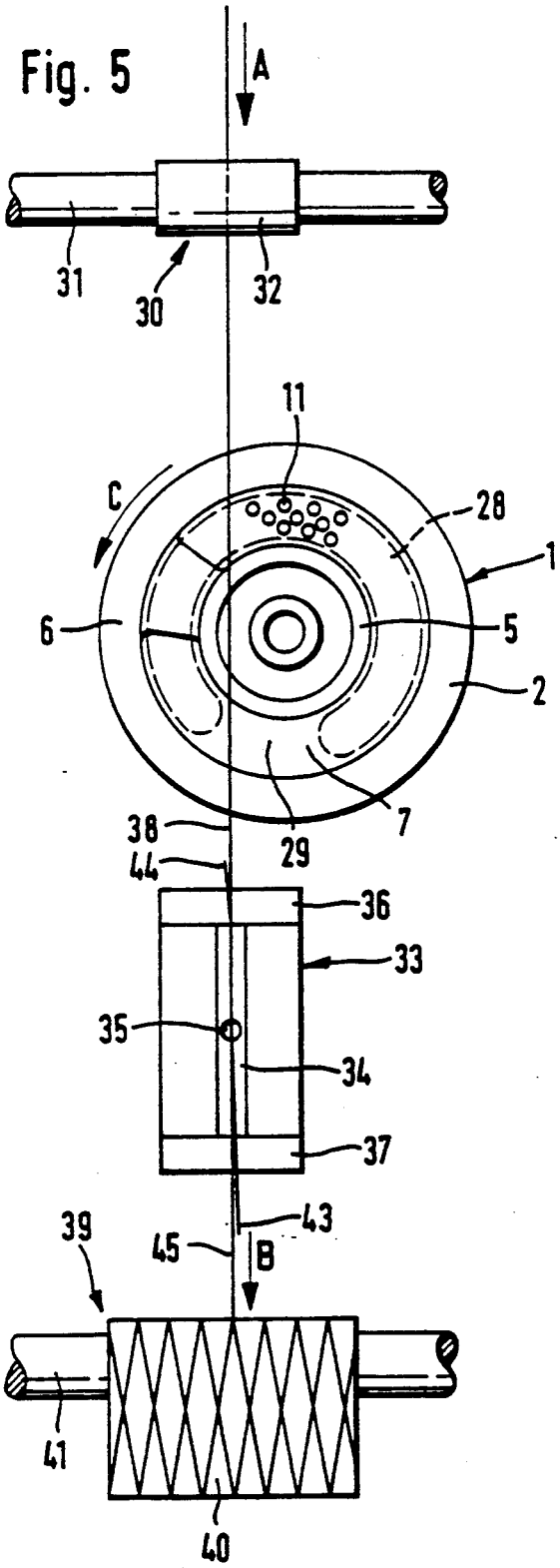
FIG. 5 is a schematic representation of the arrangement according to the invention in combination with a delivery device, a splicing device and a wind-up device for a yarn immediately before a splicing operation is carried out.

As shown in FIG. 5, the arrangement 1 is taken into the moving path of a yarn 38, in order to start operating during a piecing operation. In FIG. 5, an individual spinning unit is outlined of a spinning machine, which is equipped with a plurality of such spinning units. Each of these spinning units contains a delivery device 30, by which a yarn 38 is delivered continuously during the piecing operation. This yarn 38 is connected with a yarn 45, which is withdrawn from a partially wound spool 40. Yarn 38 and yarn 45 are placed in a splicing arrangement 33 in such a manner that their two ends 43, 44 project out of the splicing arrangement 33 on opposite sides. The splicing arrangement 33 is provided with a splicing groove 34, a compressed-air feeding device 35 and devices for the clamping and trimming of the yarn ends 43, 44.

The partially wound spool 40 is normally driven by a wind-up device 39, of which one winding roller 41 is shown. During the piecing operation, i.e., during the finding and returning of the yarn 45, the partially wound spool 40 is lifted off this winding roller 41 and is driven in wind-off direction by means of a driving element of a servicing device which is not shown. This not shown servicing device also contains the splicing arrangement 33 and arrangement 1, which are moved into the path of the yarn.

In FIG. 5, a situation is shown, which occurs immediately before a splicing operation. In this situation, the yarns 38, 45 and their ends 43, 44 have already been released by the respective feeding devices and fastened in the splicing arrangement 33. The withdrawal of the yarn 38 delivered by the delivery device 30, which had taken place up to then, for example, by means of a suction device, is interrupted, so that, starting at this moment, the continuously supplied yarn quantity must be stored until the splicing operation is concluded. After the splicing, the partially wound spool 40 is driven at an increased speed by the auxiliary device so that the yarn quantity stored during the splicing operation will be used up, after which the partially wound spool 40 is slowed down again to operational speed and is transferred to the winding roller 41.

For the storing of the continuously moving yarn 38, the ring-shaped depositing chamber 7 is acted upon by a vacuum, while the disk-shaped body 2 is driven in the direction of the arrow (C). The web 8 in the depositing chamber 7 and the interruption 29, in this case, are located in a position for moving ahead of the stored yarn 42. The intermediate disk 24 is therefore also driven in the direction of the arrow (C).

Figure 6:
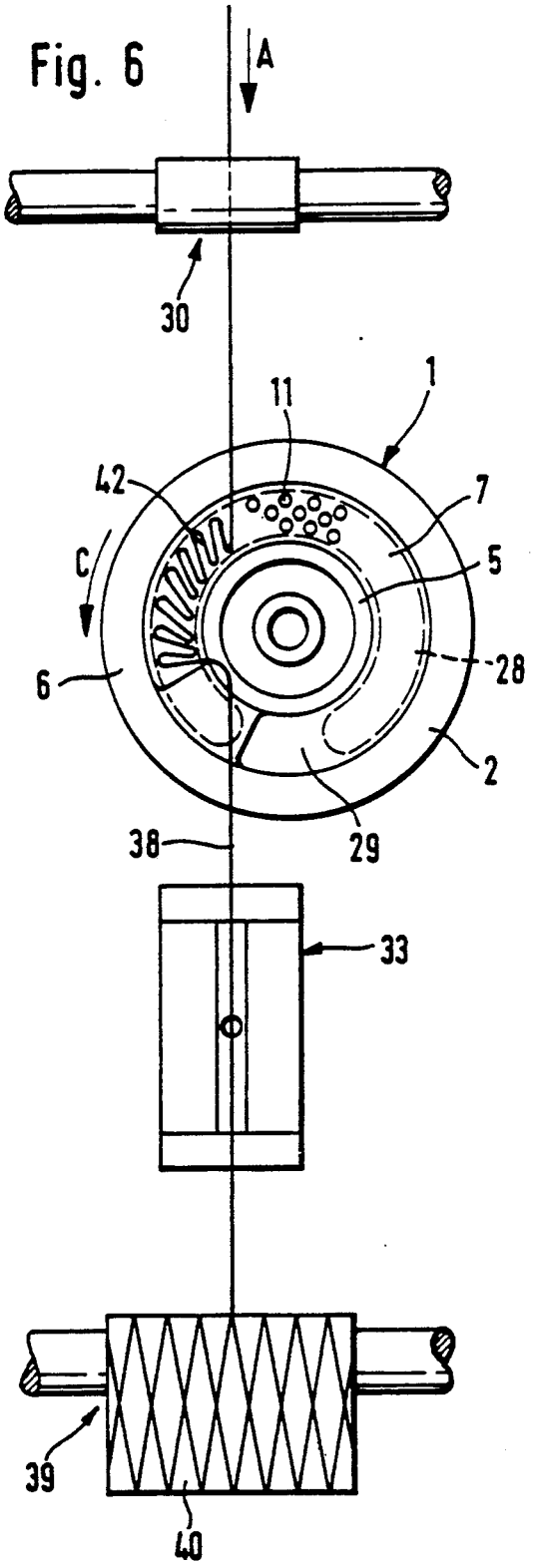
FIGS. 6 to 8 are views corresponding to FIG. 5 depicting different conditions of the arrangement according to the invention during the storing of a yarn.

As shown in FIG. 6, the running-in yarn 38 is deposited in the V-shaped depositing chamber 7 in the form of loops 42. In this case, the loops 42 of the yarn 38 overlap in an imbricated manner.

Figure 7:
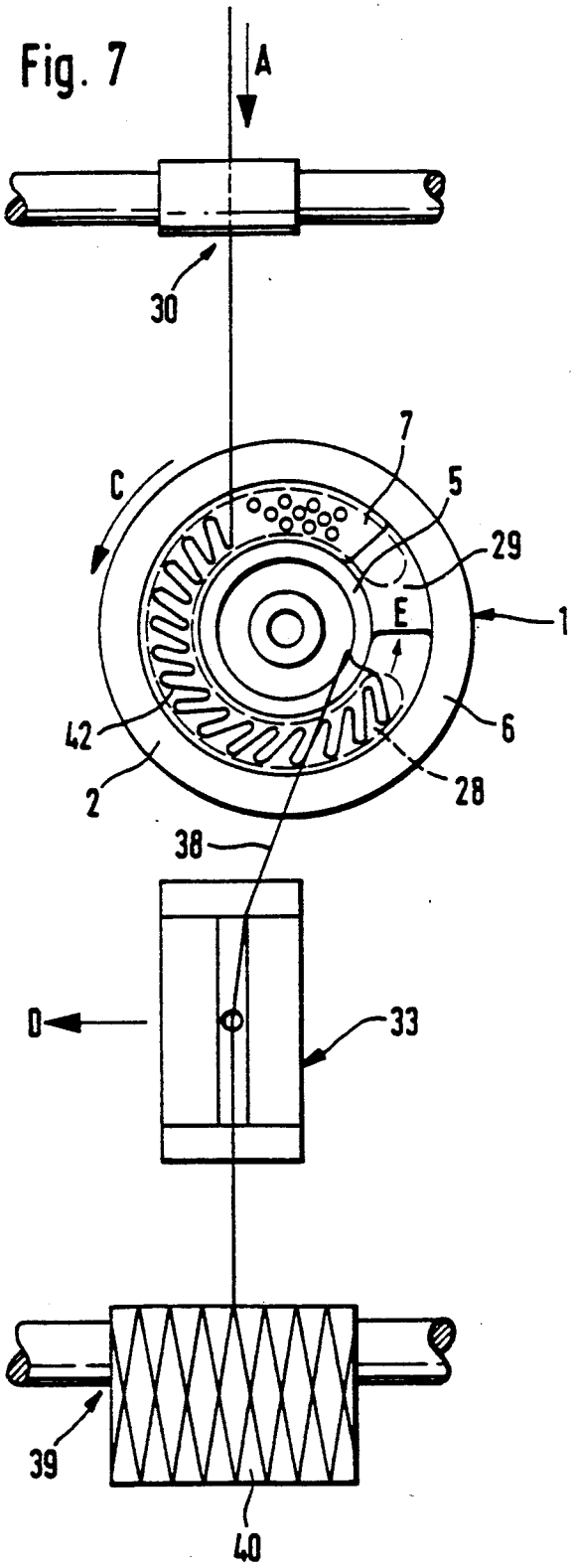
Figure 8:
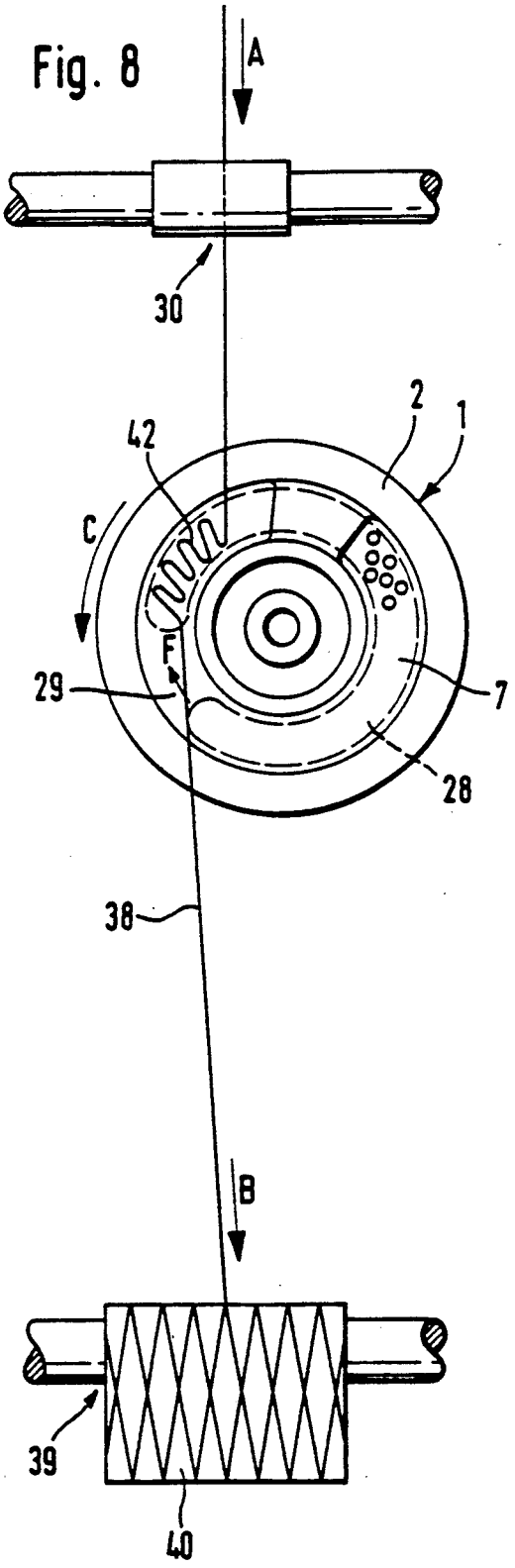

At the end of the splicing operation (FIG. 7), the pieced yarn 38 is released by the splicing arrangement 33, which will then be removed, for example, in the direction of the arrow (D). Immediately thereafter, the wind-up operation is resumed by the driving of the partially wound spool 40, whereby the yarn 38 is withdrawn again from the depositing chamber 7 (FIG. 7, 8). In this case, the yarn 38 is withdrawn over the edge enlargements 5, 6 . During this withdrawal at the increased winding speed, the intermediate disk 24 is driven in the direction of the arrow (F); i.e., against the moving direction of the depositing chamber 7. The interruption 29 of the suction slot 28, in this case, with respect to its movement, is coordinated such with the withdrawal speed of the yarn 38, that it is always located in the area of the withdrawal point from the ring chamber 7. As a result, it is achieved that the yarn 38 must not be withdrawn against the suction effect.

As soon as the yarn reserve accommodated by the arrangement 1 is used up completely, the arrangement is moved out of the area of the path of the yarn.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An arrangement for the temporary storage of a yarn between a splicing arrangement and a continuously operating yarn-delivering delivery device, comprising:

a ring shaped yarn loop depositing chamber defined in part by at least one upstanding annular wall, said depositing chamber being mountable for rotational movement about a rotational axis extending substantially parallel to the at least one annular wall, a portion of said depositing chamber being air permeable, and suction device means connected to the depositing chamber to apply suction at the air permeable depositing chamber portion to aid in the deposition of the yarn in the depositing chamber, wherein said depositing chamber is defined by a pair of said annular walls facing one another, wherein said air permeable depositing chamber portion is formed at least in part by said annular walls defining a part annular slot opening toward the suction device means, further comprising an intermediate disk disposed between said depositing chamber and the suction device means, and intermediate disk driving means for rotatably moving the intermediate disk about the rotational axis relative to the depositing chamber to thereby control the area of the part annular slot opening subjected to suction by the suction device means.

2. An arrangement according to claim 1, wherein said intermediate disk driving means includes means for driving the intermediate disk in the same rotational direction as the depositing chamber during deposition of yarn in the depositing chamber and for driving the intermediate disk in the opposite rotational direction as the depositing chamber during withdrawal of deposited yarn from the depositing chamber.

3. An arrangement according to claim 2, wherein the suction device means includes a suction chamber arranged on a rear side of the depositing chamber, said suction chamber having a suction slot which is aligned with the part annular slot at the bottom of the depositing chamber.

4. An arrangement according to claim 1, wherein said at least one annular wall is integrally formed at a depositing chamber body, said depositing chamber body including a hub with a centric bore which is engageable over a journal of a rotatably disposed shaft.

5. An arrangement according to claim 4, wherein the depositing chamber body includes a pair of said annular walls facing one another to define the depositing chamber with a front end of said annular walls facing away from the hub to form a yarn inlet to the depositing chamber, said annular walls defining a part annular slot opening toward the suction device means at a rear end of said annular walls.

6. An arrangement according to claim 5, wherein a perforated plate is clamped to the depositing chamber body at the rear end of the annular walls to form the bottom of the depositing chamber.

7. An arrangement according to claim 1, wherein said depositing chamber has a bottom wall connected with the pair of annular walls, said bottom wall being disposed to permit application of suction to the depositing chamber by the suction device means.

8. An arrangement according to claim 1, wherein the depositing chamber has a V-shaped cross-section defined by the annular walls.

9. An arrangement according to claim 8, wherein the suction device means includes a suction chamber arranged on a rear side of the depositing chamber, said suction chamber having a suction slot which is aligned with the part annular slot at the bottom of the depositing chamber.

10. An arrangement according to claim 1, wherein the suction device means includes a suction chamber arranged on a rear side of the depositing chamber, said suction chamber having a suction slot which is aligned with the part annular slot at the bottom of the depositing chamber.

11. An arrangement for the temporary storage of a yarn between a splicing arrangement and a continuously operating yarn-delivering delivery device, comprising:

a ring shaped yarn loop depositing chamber defined in part by at least one upstanding annular wall, said depositing chamber being mountable for rotational movement about a rotational axis extending substantially parallel to the at least one annular wall, a portion of said depositing chamber being air permeable, and suction device means connected to the depositing chamber to apply suction at the air permeable depositing chamber portion to aid in the deposition of the yarn in the depositing chamber, wherein said at least one annular wall is integrally formed at a depositing chamber body, said depositing chamber body including a hub with a centric bore which is engageable over a journal of a rotatably disposed shaft, wherein the depositing chamber body includes a pair of said annular walls facing one another to define the depositing chamber with a front end of said annular walls facing away from the hub to form a yarn inlet to the depositing chamber, said annular walls defining a part annular slot opening toward the suction device means at a rear end of said annular walls, wherein a perforated plate is clamped to the depositing chamber body at the rear end of the annular walls to form the bottom of the depositing chamber, further comprising an intermediate disk disposed between said depositing chamber and the suction device means, and intermediate disk driving means for rotatably moving the intermediate disk about the rotational axis relative to the depositing chamber to thereby control the area of the part annular slot opening subjected to suction by the suction device means.

12. An arrangement according to claim 11, wherein said intermediate disk driving means includes means for driving the intermediate disk in the same rotational direction as the depositing chamber during deposition of yarn in the depositing chamber and for driving the intermediate disk in the opposite rotational direction as the depositing chamber during withdrawal of deposited yarn from the depositing chamber.

13. An arrangement according to claim 12, wherein said depositing chamber body includes a solid web portion closing off a portion of the bottom of the part annular slot formed by the annular walls, wherein said intermediate disk includes a part annular slot which is dimensioned similar to the part annular slot defined by the annular walls, said intermediate disk including a solid web portion which corresponds to the solid web portion of the depositing chamber body when in a first relative rotation position with respect to the intermediate disk.

14. An arrangement according to claim 13, wherein each of the intermediate disk and the depositing chamber body are rotationally drivable independently of one another for accommodating yarn deposition and withdrawal with control of the suction forces to the depositing chamber being varied by the relative rotative position of the respective web portions.

* * * * *